United States Patent [19]

Greenberg

[11] Patent Number: 4,869,495

[45] Date of Patent: Sep. 26, 1989

[54] ARM EXERCISE DEVICE

[76] Inventor: S. Elliot Greenberg, 4300 Houma Blvd., Metairie, La. 70002

[21] Appl. No.: 286,241

[22] Filed: Dec. 19, 1988

Related U.S. Application Data

[63] Continuation of Ser. No. 142,655, Jan. 11, 1988, abandoned.

[51] Int. Cl.[4] ..... A63B 21/00

[52] U.S. Cl. ..... 272/93; 272/78; 272/143; 273/414; 181/131

[58] Field of Search ..... 272/93, 94, 126, 128, 272/143, 78, DIG. 9; 273/414, DIG. 17, DIG. 19; 446/236, 246, 247, 266; 181/131; 84/400

[56] References Cited

U.S. PATENT DOCUMENTS

| | | | |
|---|---|---|---|
| 1,430,175 | 9/1922 | Mazzeri | 84/400 |
| 1,753,318 | 4/1930 | Costello | 272/143 X |
| 3,214,166 | 10/1965 | Gaudet | 446/247 X |
| 3,542,364 | 11/1970 | Gaumond | 273/DIG. 17 X |
| 4,071,241 | 1/1978 | Cortes Garcia | 272/143 X |
| 4,130,276 | 12/1978 | Tricarico | 273/414 X |
| 4,226,162 | 10/1980 | Ebach | 181/131 X |
| 4,633,971 | 1/1987 | Robbins | 181/131 |

FOREIGN PATENT DOCUMENTS

| | | | |
|---|---|---|---|
| 2242697 | 3/1974 | Fed. Rep. of Germany | 272/128 |
| 2654604 | 6/1978 | Fed. Rep. of Germany | 272/94 |
| 22954 | of 1903 | United Kingdom | 272/128 |

*Primary Examiner*—Richard J. Apley
*Assistant Examiner*—Robert W. Bahr
*Attorney, Agent, or Firm*—Keaty & Keaty

[57] ABSTRACT

The present invention relates to an upper body exercising device for use while jogging, comprising a non-continuous collar for positioning around a user's neck attached by a strap to a lightweight tossing object.

2 Claims, 1 Drawing Sheet

FIG. 1

ARM EXERCISE DEVICE

This is a continuation of application Ser. No. 142,655, filed Jan. 11, 1988 now abandoned.

1. Field of the Invention

The present invention relates to a device for upper body exercise, or specifically to devices for exercising arms and upper torso during walking or jogging.

It is well known that unless a person is in some type of profession or sport which uses the arms continuously, for example, a painter, an orchestra leader, or a basketball player, one's arms usually never get enough exercise. The evidence is clear, for example, when swimming tires us out, the fatigue is usually not in the legs but in the arms and thorax. The fatigue in long sets of tennis is more often felt in the shoulder than in the pelvis and eve the arms of a professional boxer tire more easily than his legs.

Enough data is available for physiologists to agree that lower body exercises, as epitomized by jogging, may not be the be-all and end-all of exercise, but they also do not agree that arm exercise alone is sufficient, even when the definition is expanded to include the muscle groups of the back, shoulders and chest. In conclusion, the best exercise programs available include both arm and leg exercises. Cross country skiing has been long counted as an ultimate exercise. Swimming has been called the best all around exercise and rowers have shown time and time again to have high oxygen uptake values.

The essential point when prescribing exercise is to have people use a large amount of muscle mass and in that respect a device for upper body exercise during jogging or brisk walking is considered ideal.

One of the benefits of jogging and brisk walking is that it enhances cardiac output and improves the efficiency of the heart and coronary vessel. Evidence indicates that supervised or regulated jogging or brisk walking is beneficial to the heart. It is known that jogging or brisk walking thickens the heart wall muscle allowing the heart to function and perform better.

And the notion is the same with vigorous arm exercising, which is to develop the upper muscle group for better coordination, efficiency and health.

Further, in cardiac rehabilitation it was discovered that roughly 60–80% of ones maximum exercise heart rate would increase cardiac reserve and efficiency by improving maximum oxygen uptake and that this target heart rate elevation could be achieved by vigorous arm movement while jogging or briskly walking.

There are many exercising devices for eye-hand and eye-foot coordination. One of the known devices has a rather large ball for kicking which is attached to a long elastic strap and is positionably secured around a user's neck or waist such that the ball may be kicked, swinging outwardly away from the player's foot and back toward his foot where it may be kicked again, the process being repeated by the player in an attempt to record a number of successive kicks.

Another device is made in the form of a head band having a ball secured thereon by a long elastic strap for punching or striking with the paddle in an attempt to establish a record number of successive hits.

All of these devices suffer from the same disadvantages: they do not allow for a controlled exercise by the use of the hands while allowing one to jog or walk briskly at the same time.

It is therefore an object of the present invention to provide a device for exercising the arms or upper torso while allowing the exercise to walk briskly or jog without hindrance or obstruction by the upper torso exercising device.

It is another object of the present invention to provide an upper torso exercise device for use while walking or jogging which is easily positioned and removed upon completion of the exercise.

It is a further object of the present invention to provide an exercise device which is easy and inexpensive to manufacture.

Other objects of the invention will be obvious to those skilled in the art from the following description of the invention.

SUMMARY OF THE INVENTION

The present invention solves above-outlined problems and achieves the objects in a simple and straightforward manner. The upper body exercise device for use while walking or jogging comprises a collar means for positioning around a user's neck and a lightweight tossing object attached to the collar by a flexible connecting means.

DETAILED DESCRIPTION OF THE PREFERRED EMBODIMENT

Figure 1:
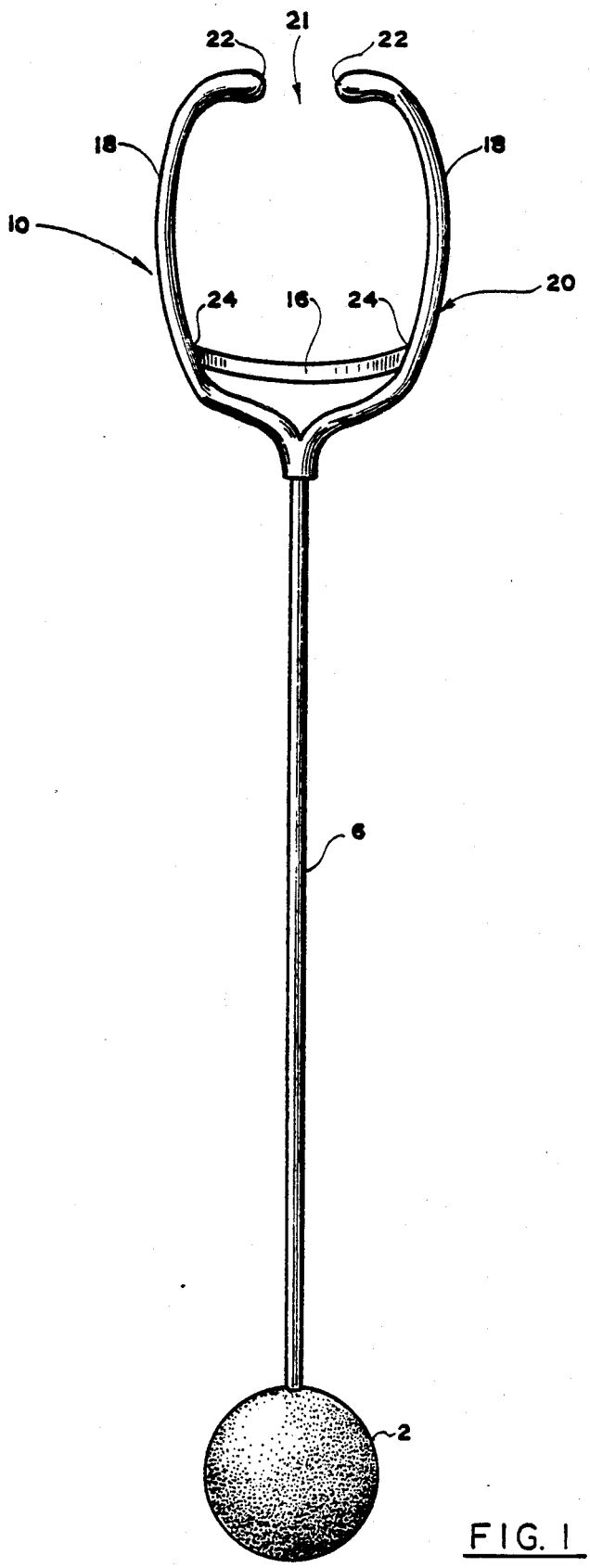
FIG. 1 is a perspective view of the present invention.

Reference will now be made to the drawing illustrating the present invention.

As can be seen in the drawing, the arm exercise device in accordance with the present invention is designated by numeral 10. The exercise device comprises a means for securing the exercise device and suspending it from the neck of a user, said means comprising a non-continuous collar, such as for example a generally U-shaped yoke 20. The collar or yoke 20 is made of a non-continuous shape so as to allow the user to easily place or remove the collar 20 from his neck by utilizing an open passageway 21 formed between inner ends 22 of the yoke 20. The yoke 20 is preferably made of a light-weight, flexible material, such as molded plastic, having sufficient resiliency to allow for legs 18 of the yoke 20 to be forced apart when the yoke 20 is to be positioned around a user's neck. The same flexibility and resiliency allows for the legs to resume their generally U-shaped orientation upon positioning on the user's neck, so that the U-shaped yoke 20 does not disengage from its position, which might by the case if the resiliency of the legs 18 of the yoke 20 is not sufficient to retain the legs in their relatively close, spaced-apart orientation.

When placing the U-shaped yoke 20 around the user's neck, the user simply holds both inner ends 22 of the legs 18 in his hands and spreads them apart, moving the yoke about his neck, and subsequently releasing the ends 22 which will move closer to each other due to the features and characteristics described above, thus creating a light gripping action at opposite sides of the user's neck.

In the lower portion of the yoke 20, there is provided a bridge 16 which spans the openness of the yoke 20 and fixedly attaches to both legs 18 at points 24.

The bridge 16 facilitates structural integrity of the yoke 20 so that the legs 18 of the yoke 20 are not accidentally separated by pushing the ends 22 to far from each other. The bridge 16 also assists in retaining the legs 18 in the predetermined spaced-apart relationship, while retaining the distance at which the legs 18 are spaced.

Attached to the middle portion of the bottom of yoke 20 is an elongated flexible strap 6, the length of which can be adjusted depending on the length of the user's arms, the importance of which will be discussed hereinafter.

The second end of the flexible strap 6 carries a lightweight tossing object 2 which is fixedly attached to the flexible strap 6. The tossing object 2 can be made of a material which has sufficient flexibility and resiliency, while at the same time being lightweight to allow for the user's hand to toss the object from one hand to another, during motion, and still not apply an excessive weight on the neck of the user, while he is in motion.

The length of the strap 6 is adapted such that the user, when extending his hands in front of him, can easily pick up the tossing object suspended by the strap and start tossing it from one hand to another. Still, the tossing object is not pushed outside of the reach of the user's hands, as might by the case if strap 6 is made excessively long.

In operation, the user pulls apart the ends 22 of the legs 18 and puts them around his neck and towards the back of the neck, releases the ends 22, allowing legs 18 to return to their pre-molded spaced-apart position about the user's neck. The user then picks up the tossing object 2 into one of his hands and throws it into the air, attempting to toss the object back by his other hand, while at the same time jogging or running. The object 2 is then tossed back, with the exercise continuing until a predetermined time, thus allowing the user to exercise the arms and the upper torso. The user does not need to interrupt his run even if he wants to disengage the exercise device from its position about his neck. He can simply pull apart the ends 22 and take off the exercise device 10 from his neck. This gives the user, unencumbered jogging possibilities, with an option of retaining the exercise device during the whole time while jogging, or pausing in the arm exercise by taking the exercise device 10 from his neck or positioning it again about his neck for any period of time or frequency desired, since it is easily positionable or releasable from its engagement to the user's body.

The exercise device is accordance with the present invention can be inexpensively and easily manufactured by molding the U-shaped yoke and attaching to it a flexible strap with a resilient tossing object, such as a ball, suspended from the strap.

From the foregoing, it will be seen that there is provided an exercise device which can be molded quite quickly and inexpensively.

Having illustrated and described the principles of the invention in a preferred embodiment, it should be apparent to those skilled in the art that the invention can be modified without departing from such principles. Accordingly, I claim all modifications, within the spirit and scope of the following claims.

I claim:

1. A method of exercising arms while in motion, comprising the following steps:

providing a resilient flexible U-shaped yoke having a pair of spaced-apart legs and a continuous portion connecting the spaced-apart legs, said yoke being sized and configured for releasable positioning about a user's neck;

providing an elongated flexible strap secured at one of its ends to the continuous portion of the yoke substantially midway between the legs;

providing a lighweight tossing object securedly attached to a second end of the flexible strap;

positioning the yoke about the user's neck by first moving the yoke legs apart until the yoke is in substantially surrounding relationship about the user's neck and then releasing the legs allowing the legs to resiliently spring back and return to their original spaced-apart position;

grasping the tossing object by one hand of the user; and tossing the tossing object from one hand of the user to another wile the user is in motion, thus exercising user's arms during motion without obstruction by the exercise device.

2. The method of claim 1, wherein the tossing object is a flexible ball.

* * * * *